US005496385A

United States Patent [19]

Scheider et al.

[11] Patent Number: 5,496,385

[45] Date of Patent: Mar. 5, 1996

[54] INTERNAL FINISHING TOOL AND METHOD OF MAKING SAME

[75] Inventors: Alfred F. Scheider, Orange; R. Brown Warner, Westlake, both of Ohio

[73] Assignee: Jason, Inc., Cleveland, Ohio

[21] Appl. No.: 380,641

[22] Filed: Jan. 19, 1995

Related U.S. Application Data

[62] Division of Ser. No. 751,335, Aug. 29, 1991, Pat. No. 5,404,681.

[51] Int. Cl.[6] ..... B24D 18/00

[52] U.S. Cl. ..... 51/293; 51/298

[58] Field of Search ..... 451/466–469, 451/526, 533; 51/293, 298

[56] References Cited

U.S. PATENT DOCUMENTS

| | | | |
|---|---|---|---|
| 1,897,971 | 2/1933 | Johnson | 451/469 |
| 2,049,324 | 7/1936 | Schneider | 451/468 |
| 2,447,748 | 8/1948 | Graham | 451/469 |
| 2,524,626 | 10/1950 | Harman | 451/468 |
| 2,599,961 | 6/1952 | White | 451/469 |
| 2,763,104 | 9/1956 | Lindenborg | 451/469 |
| 3,869,833 | 3/1975 | Belanger | 451/469 |
| 5,155,945 | 10/1992 | Tyler et al. | 451/463 |

*Primary Examiner*—Maurina T. Rachuba
*Attorney, Agent, or Firm*—Renner, Otto, Boisselle & Sklar

[57] ABSTRACT

A twisted stem helical internal abrading and finishing tool is formed from abrasive containing plastic strips having transverse offset slits along the lateral edges and a longitudinal middle unslit portion. The strips may be stacked with the longitudinal middle unslit portions aligned with the longitudinal axis of a cotter pin, one end of the stack being placed in the bight of the cotter pin. The cotter pin is twisted about its longitudinal axis to form a helical twisted stem from which the slit lateral side or edges extend forming rectangular abrasive fingers uniformly helically arranged. The end of the cotter pin opposite the bight may be inserted into the chuck of a drilling or turning machine to hold and rotate the tool about the axis of the stem.

6 Claims, 1 Drawing Sheet

INTERNAL FINISHING TOOL AND METHOD OF MAKING SAME

This is a division of application Ser. No. 07/751,335 filed on Aug. 29, 1991, now U.S. Pat. No. 5,404,681.

DISCLOSURE

This invention relates generally to internal abrasive finishing tools and a-method for making same.

BACKGROUND OF THE INVENTION

Twisted stem internal finishing tools of helical configuration are used in the finishing of precision products having close tolerance having threaded or drilled holes or other interior curved surfaces. Such tools must therefore provide a uniform and precise finishing face, be durable to withstand continuous rotation and contact with the work piece, and producible in a wide range of sizes with various abrasive grades. Known embodiments of helical internal finishing tools such as disclosed in co-pending application Ser. No. 07/519,632 entitled, Abrasive Finishing Tool, are assembled by arranging and fixing individual bristles or filaments on a tool stem, such as a cotter pin, which is clamped upon the individual abrasive filaments in the bight of the cotter pin and then twisted to form a helical tool. The filaments of such tools may be made from plastic abrasive strips as disclosed in co-pending application Ser. No. 07/471,385 entitled, Abrasive Finishing Elements, Tools Made From Such Elements, and Methods of Making Such Tools.

The difficulty of constructing finishing tools with individual bristles or filaments arises in attempting to arrange and uniformly align each bristle or filament in an exact and precise formation to create the desired tool face dimensions with a precise finishing face to the tool. A tool in which even one of the filament tips is out of alignment from the helical arc formed by the ends of the filaments can damage the work piece by creating a groove or gouge therein. Such tools are also usually too small to be effectively and economically trimmed.

Another problem associated with the production of internal finishing tools having individual bristles or filaments is the difficulty of stacking the bristles to produce a tool with a wide finishing face. Bristles or filaments with a round cross section are particularly difficult to stack. Filaments with a cross section having flat surfaces, though stackable, are difficult to keep aligned or stacked uniformly adjacent one another as they are clamped in the bight of a cotter pin. Misalignment of even a single filament results in an imprecise and unbalanced tool unsuitable for precision applications. It is therefore desirable to have a simplified and low cost method of producing a finishing tool in which the abrasive filaments are arranged in an exact and precise manner, and are easily held in such arrangement when attached to a tool stem.

SUMMARY OF THE INVENTION

The present invention provides a precision twisted stem abrasive finishing tool and a method for making such tool. According to the invention, an elongate strip of abrasive containing plastic is cut to a given length. Transverse slim are made in the lateral edges of the abrasive strip to form a series of rectangular abrasive fingers. The slits on one edge of the strip are longitudinally offset from the slits on the opposite edge of the strip. Strips of equal length may be stacked directly upon each other to form an abrasive body having a desired thickness. The central longitudinal unslit portion of the strip is aligned with the longitudinal axis of a corer pin with an end of the strip placed in the bight of the cotter pin. The cotter pin is clamped down upon the strip and then twisted to form a helical twisted stem abrading tool. The slit edges of the strip extending from the twisted stem form a precise continuous helical pattern of rectangular offset abrasive plastic fingers. The slim in the lateral edges of the strip can be made with different angles and patterns to form tools with abrasive plastic fingers of varying shapes, widths and flexibility for different applications.

To the accomplishment of the foregoing and related ends, the invention comprises the features hereinafter fully described in the specification and particularly pointed out in the claims, the following description and the annexed drawings setting forth in detail certain illustrative embodiments of the invention, these being indicative, however, of but a few of the various ways in which the principals of the invention may be employed.

DETAILED DESCRIPTION OF THE PREFERRED EMBODIMENTS

Figure 1:
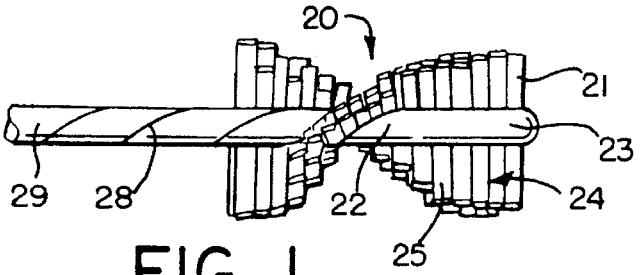
FIG. 1 is a partial side elevation of a helical twisted stem internal finishing tool with abrasive strip cuts Stacked and aligned in the bight of a cotter pin.

FIG. 1 illustrates from the side a portion of a helical twisted stem internal finishing tool, indicated generally at 20. Rectangular sections of elongate abrasive strip 21 are stacked on top of each other and aligned with the longitudinal axis of cotter pin 22 with the ends of the strips positioned in the bight 23 of cotter pin 22. Transverse offset slits 24 are formed in the lateral edges of the abrasive strips to form rectangular fingers 25. The cotter pin 22 is twisted about its longitudinal axis to form a helical seam 28 from which extend the offset abrasive rectangular fingers 25 in a continuous uniform helical pattern along the length of the abrasive strip 21. The end portion 29 of cotter pin 22 serves as the tool stem which may, for example, be inserted directly into and gripped by the chuck or collet of a drilling or finishing machine for powered rotation of the tool about the axis of the stem. The number of times the cotter pin is twisted or rotated about its longitudinal axis determines the helix angle in which the abrasive fingers 25 are arranged and may vary the resultant abrasive and finishing characteristics of the tool.

Figure 2:
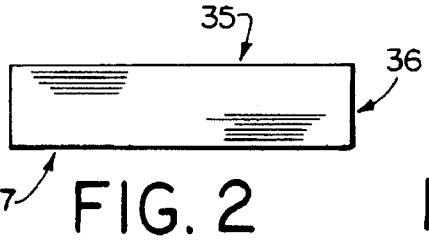
FIG. 2 is a plan view of a cut of abrasive strip.

FIG. 2 is a plan view of a section of abrasive strip, indicated generally at 35, illustrating the generally rectangular shape of the strip when cut to the desired length. The width 36 of the strip is generally fixed as a function of the extrusion process by which the strip is manufactured, although strips could be slit to narrower widths. The length 37 of the section of strip may be selected to create tools of varying axial length.

The strips may be made of nylon, aramids or polyester. A preferred embodiment is 6/12 nylon which has excellent resistant to oils and greases, superior performance against repeated impact abrasion and fatigue, a low coefficient of friction, high tensile strength, and toughness. Useful mechanical properties of nylon include strength, stiffness and toughness. Also, the composition of the nylon polymer chain may be adjusted to achieve the desired stiffness, tensile strength, and melting point. Some of the desirable nylon variations include:

(a) Nylon 6 synthesized from hexamethyl enediamine (HMD) and adipic acid;

(b) Nylon 6/9 synthesized from HMD and azelaic acids;

(c) Nylon 6/10 synthesized from HMD and sebacic acids;

(d) Nylon 6/12 synthesized from HMD and dodecanedioic acid;

(e) Nylon 6 synthesized from polycaprolactam;

(f) Nylon 11 synthesized from 11 aminoundecaianoic acid; and (g) Nylon 12 synthesized from polyaurolactum.

Nylons used in the present invention have a Young's modulus greater than 0.05, preferably greater than 0.1, and preferably greater than 0.2. Physical properties of the preferred nylon 6/12 include a melting point of 212 degrees C., a dry yield strength at $10^3$ psi of 8.8 (7.4 at 50% RH), and a dry flexural modulus of 295 (180 at 50% RH). Nylon has a tensile strength of greater than 8,000 psi, and exhibits 250% breakage during elongation.

Another type of polyamide useful in the production of the strips in the present invention includes aramids, defined as a manufactured fiber in which at least 85% of the amide (—C(O)—N(H)—) linkages are attached directly to two aromatic hydrocarbon rings. This is distinguished from nylon which has a less than 85% of the amide linkages attached directly to aromatic rings.

Aramid fibers have high tensile strength and high modulus. Two preferred forms of aramids useful in the present invention include fiber formed from the polymerization of p-phenylenediamine with terephthaloyl chloride. These forms of aramids possess improved stiffness characteristics, strong resistance to solvents, and tensile strengths at 250 degrees C. comparable to textile fibers at room temperature.

Some thermal set polymers are also useful in the present invention. These include polyesters of long chain synthetic polymers with at least 85% of dihydric alcohol ester (HOROH) and terephthalic acid (p-$HOOCC_6H_4COOH$). Polyesters are also resistant to solvent and demonstrate breaking elongation of 19–40%.

The abrasive material embedded in the strip substrate may vary widely in amount, type and granular or grit size. For example, the abrasive material may range from aluminum oxide and silicon carbide to the more exotic polycrystalline diamond or cubic boron nitride. The amount of abrasive material distributed homogeneously throughout each strip may range up to about 30 to 45% by weight of the strip.

Figure 3:
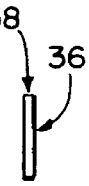
FIG. 3 is an end view of a cut of abrasive strip, drawn to the same scale as FIG. 2 to illustrate the thickness of the strip relative to its width and length.

FIG. 3 is an end view of the same section of abrasive strip as shown in FIG. 2 illustrating the thickness 38 of the strip relative to its width 36 and length 37. A preferred width to thickness ratio is about 30:1, or about 3 cm to 1 mm. Thicker strips may be used to create stiff abrasive fingers for heavy duty applications. Tape thicknesses can vary from about 0.010 inches (0.254 mm) to about 0.060 inches (1.524 mm with incremental sizes in between.

Figure 4:
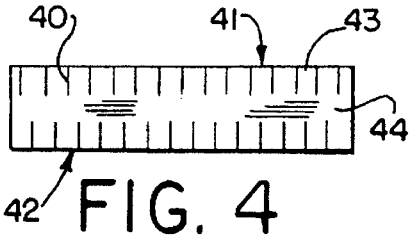
FIG. 4 is a plan view of a cut of abrasive strip having offset transverse slim along opposing lateral edges of the strip.

FIG. 4 is a plan view of a section of abrasive strip in which transverse longitudinally offset slits 40 have been made in opposing lateral edges 41 and 42. The slits 40 create a fixed series of evenly dimensioned abrasive fingers 43, offset from the fingers on the opposite lateral edge of the strip by one-half the width of one finger, so that each slit is laterally opposite the midpoint between the opposite edge. The abrasive fingers 43 have a simple rectangular shape with selected widths ranging from, for example, about 0.050 inches (1.27 mm) to about 0.090 inches (2.286 mm). This slit pattern is suitable for general internal deburring, edge radiusing, brush honing, and surface texturing. Wider slit patterns for larger heavy duty work may have widths ranging from about 0.090 (2.286 mm) to about 0.250 inches (6.35 mm). A central unslit longitudinal portion of the strip 44 provides an uninterrupted surface upon which a cotter pin may be clamped to securely hold the strip. It should be noted that the strip remains in one piece after the longitudinal transverse slits are made. Each abrasive finger 43 is permanently attached to central potion 44 and the relative position of each finger on the strip is fixed. Thus a large number of loose filaments are avoided.

Figure 5:
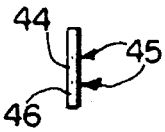
FIG. 5 is a cross-section of a cut of abrasive strip, drawn to the same scale as FIG. 4.

FIG. 5 is a cross-section of the section of abrasive strip as shown in FIG. 4. Dotted lines 45 indicate the depth to which the transverse slits extend into the cross section of the strip. Portion 46 represents the length of the abrasive fingers extending from the longitudinal central unslit portion 44 of the strip.

Figure 6:
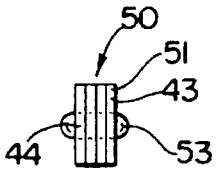
FIG. 6 is an end view of four cuts of abrasive strip arranged side by side.

FIG. 6 is an end view of an assemblage of four stacked sections of identical abrasive strip which create finishing face 50 formed by adjacent tips 51 of abrasive fingers 43. Cotter pin 53 is shown from the end opposite the bight, clamping the assemblage of abrasive strip sections about the central longitudinal unslit portion 44. As can be seen from FIG. 6, the unslit portion is about the same width as the pin and is normally obscured by the pin. The number of strips stacked may vary, with the thickness of each strip no greater than about 0.060 inches (1.524 mm) with an overall stack height of about 0.500 inches (12.7 mm), depending on the size of the tool being made.

Figure 7:
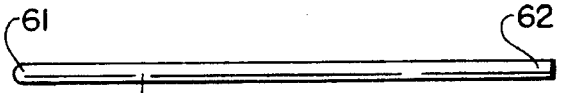
FIG. 7 is a side elevation of a cotter pin which is used as the tool stem.

FIG. 7 is a side elevation of a cotter pin 60 having a bight 61 and a separable end portion 62. Each leg of the pin has the half-round sections seen in FIG. 6.

Figure 8:
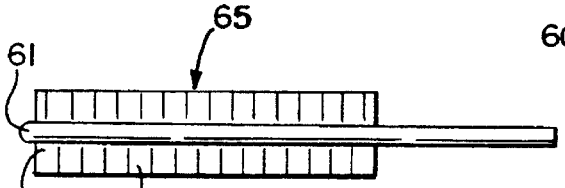
FIG. 8 is a side elevation of a section of abrasive strip with offset transverse slits along the longitudinal edges aligned with the longitudinal axis of a cotter pin and positioned in the bight of a cotter pin.

FIG. 8 is a side elevation of the cotter pin as shown in FIG. 7 with at least one transversely slit abrasive strip 65 aligned with the longitudinal axis of the cotter pin with an end 66 of the strip positioned in the bight 61 of the cotter pin. Abrasive fingers 43 extend normal to the longitudinal axis of the cotter pin and are longitudinally offset. Twisting of the stem will produce the tool of FIG. 1 with the fingers arranged in a uniform helical pattern and firmly gripped.

Figure 9:
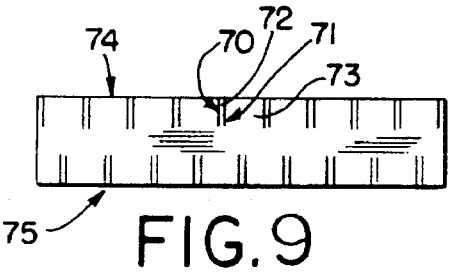
FIG. 9 is a plan view of a section of abrasive strip which has a double offset transverse slit pattern along the longitudinal edges.

FIG. 9 is a plan view of a section of abrasive strip having an alternating transverse slit pattern wherein two closely spaced slits 70 and 71 form a very narrow abrasive finger 72 having a width of, for example, 0.090 inches (0.2286 mm). The pair of closely spaced slits 70 and 71 are then repeated but at an extended distance along the lateral edge of the strip thereby creating abrasive finger 73 of greater relative width to finger 72, such as, for example, 0.250 inches (6.35 mm). The alternating pattern of wide and narrow abrasive fingers produces a tool particularly suited for some applications. It will also be noted that the closely spaced pairs of slits in lateral edge 74 are offset from those in lateral edge 75 to achieve continuous uninterrupted abrasive action of fingers of alternating size against the work piece. The offset again achieves the uniform helical array.

Figure 10:
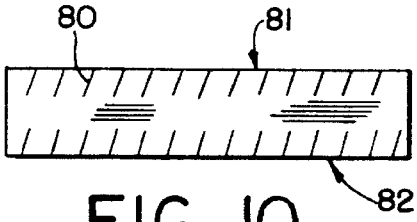
FIG. 10 is a plan view of a section of abrasive strip which has a diagonal offset transverse slit pattern along the longitudinal edges.

FIG. 10 is a plan view of a section of abrasive strip having diagonal transverse offset slits 80 in lateral edges 81 and 82. This embodiment of the strip portion of the tool is suited, for example, for self-threading the tool into, for instance, a threaded hole for the purpose of deburring such threads and cleaning the work piece. The angle of the slits may be selectively varied for application to threads of different size and pitch. Again the opposite side offset provides a uniform helical array.

Figure 11:
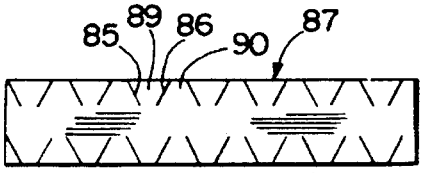
FIG. 11 is a plan view of a section of abrasive strip which has an alternating diagonal offset transverse slit pattern along the longitudinal edges.

FIG. 11 is a plan view of a section of an abrasive strip having alternating diagonal slits 85 and 86 in lateral edges 87 and 88. Slits 85 and 86 are also offset so that diagonal slits 85, which slant from left to right as seen in such figure do not align transversely with the left to fight slits in the opposite lateral edge of the strip. Diagonal slits 86 slanted from right to left are similarly offset. This alternating diagonal pattern produces along the lateral edge of the strip a wide angle abrasive finger 89 immediately adjacent a narrowing abrasive finger 90. This pattern provides abrasive fingers of increased flexibility and is suitable for heavy duty work and application to smaller holes or bores.

Although the invention has been shown and described with respect to several preferred embodiments, it is obvious that equivalent alterations and modifications, particularly to the slit patterns in the abrasive strip and the helix angle in the tool stem, will occur to those skilled in the art upon reading and understanding this specification. The present invention includes all such equivalent alterations and modifications, and is limited only by the scope of the claims.

We claim:

1. A method of making a twisted stem abrading tool comprising the steps of forming an elongated strip of abrasive containing plastic, cutting the strip to a given length, forming transverse slits into the lateral edges of the strip, the slits on one edge being longitudinally offset from the slits on the opposite edge, placing the strip in the bight of a cotter pin, and clamping and twisting the corer pin to form a helical twisted stem abrading tool, the slit edges of the strip forming a helical pattern of abrasive plastic fingers.

2. A method as set forth in claim 1 including the step of spacing the slits on one edge of the strip laterally opposite the midpoint between the slits on the opposite edge.

3. A method as set forth in claim 1 including the step of stacking a plurality of strips thus cut and slit, and placing the stacked strips in the bight of a cotter pin to be clamped and twisted to form such tool.

4. A method as set forth in claim 3 including the step of stacking a number of cut and slit strips in the bight of the cotter pin.

5. A method as set forth in claim I including the step of terminating the slits which extend laterally inwardly from the edge of the strip at a substantially uniform depth to provide an unslit longitudinally extending center portion.

6. A method as set forth in claim 5 including the step of terminating said slits to provide an unslit center portion which is approximately the same width as said cotter pin.

* * * * *